US006401253B2

(12) United States Patent
Brunson

(10) Patent No.: US 6,401,253 B2
(45) Date of Patent: Jun. 11, 2002

(54) WORKER'S AID SYSTEM AND MODIFIED GLOVE

(76) Inventor: Mark E. Brunson, P.O. Box 532, Bellefontaine, OH (US) 43311

( * ) Notice: Subject to any disclaimer, the term of this patent is extended or adjusted under 35 U.S.C. 154(b) by 0 days.

(21) Appl. No.: 09/792,560

(22) Filed: Feb. 23, 2001

Related U.S. Application Data

(60) Provisional application No. 60/197,370, filed on Apr. 14, 2000.

(51) Int. Cl.[7] ..... A41D 19/00

(52) U.S. Cl. ..... 2/160; 206/818; 224/183; 224/218; 224/901.8

(58) Field of Search ..... 2/159, 160, 161.6; 224/901.8, 183, 218, 219; 206/818, 234, 373, 503; 81/490

(56) References Cited

U.S. PATENT DOCUMENTS

| | | | | |
|---|---|---|---|---|
| 3,629,867 | A | * | 12/1971 | Taylor |
| 4,244,057 | A | * | 1/1981 | Burnham |
| 4,325,504 | A | * | 4/1982 | Amani |
| 4,826,059 | A | | 5/1989 | Bosch et al. ..... 224/183 |
| 5,003,637 | A | * | 4/1991 | Lonon |
| 5,056,661 | A | | 10/1991 | Balzano ..... 206/372 |
| 5,063,679 | A | * | 11/1991 | Schwandt |
| 5,201,444 | A | * | 4/1993 | Simonet |
| 5,213,240 | A | * | 5/1993 | Dietz et al. |
| 5,333,767 | A | * | 8/1994 | Anderson |
| 5,345,368 | A | * | 9/1994 | Huff |
| 5,471,681 | A | | 12/1995 | Ferrini ..... 2/160 |
| D367,757 | S | * | 3/1996 | Liu |
| 5,593,073 | A | | 1/1997 | Finnegan ..... 224/183 |
| 5,758,807 | A | | 6/1998 | Wright ..... 224/183 |
| 5,797,670 | A | * | 8/1998 | Snoke et al. |
| 5,810,525 | A | * | 9/1998 | Ector, Sr. |
| 5,887,839 | A | * | 3/1999 | Smith et al. |
| 6,088,862 | A | * | 7/2000 | Bulcock |

FOREIGN PATENT DOCUMENTS

| | | | |
|---|---|---|---|
| FR | 2612051 | * | 9/1988 |
| JP | 176858 | * | 6/2000 |

* cited by examiner

*Primary Examiner*—Rodney M. Lindsey
(74) *Attorney, Agent, or Firm*—David A. Greenlee

(57) ABSTRACT

A worker's glove comprises a glove body having fingers, a palm and a back. A hook-and-loop fastening system mounts a worker's aid device on the glove back. The device is one or more devices selected from the group consisting of a magnetic container, a flashlight, a tape measure, a plumb bob, and a note pad. In a preferred embodiment, the magnetic container is a cylindrical cup having a magnet for securing screws, nut, bolts and other magnetizable fasteners within the cup for ready access by the worker. Several different devices can be stacked on the glove back. The devices can also be mounted on the butt end of a drill handle.

10 Claims, 3 Drawing Sheets

WORKER'S AID SYSTEM AND MODIFIED GLOVE

REFERENCE TO RELATED APPLICATION

This application claims priority of Provisional Application No. 60/197,370 filed Apr. 14, 2000.

BACKGROUND OF THE INVENTION

1. Technical Field

This invention relates to worker's aids and a glove modified to incorporate these aids and, more particularly, to an aid system comprising a plurality of worker's aids that are mountable to a glove or to a tool singly or in combination to facilitate completion of jobs which require the use of hand tools.

2. Background Art

Many jobs done by workers require the use of hand tools and many accessories. For example, the job of hanging dry wall requires the worker to use a hand drill to drive screws through the dry wall to secure it to studs. For high walls and ceilings, this requires the worker to mount a ladder. In all cases, the worker must keep a supply of screws handy for convenience and to save time. Usually, this supply of screws is kept in an apron pouch in which they are jumbled. When the worker blindly sticks his hand into the pouch to retrieve a screw, he usually encounters the points of several screws, which can nick the skin or cut beneath the fingernail, both of which are painful. The same problem is encountered by carpenters and their use of nails.

In addition, many other worker aids are needed for these types of jobs, such as a plumb bob, a level, a tape measure, note paper, and flashlight. A worker must hang all these devices from a tool belt or keep them in apron or pants pockets. If not, he must dismount a ladder and seek them out. Doing this costs time and inconvenience, both of which present a problem to the efficient use of worker's time.

This problem has been only partially recognized insofar as fasteners are concerned. In U.S. Pat. No. 5,593,073—Finnegan, a wrist band that is secured to a farrier's wrist and includes a magnet to which attracts horseshoe nails located in a pocket.

Another proposed solution is to provide a holder having a magnet that attracts screws and is fastened to a worker's belt, as shown in U.S. Pat. No. 5,758,807—Wright. This device maintains the screws in an exposed condition, subject to being scraped off by engaging a ladder, or other impediment, and still requires the worker to retrieve screws blindly, exposing him to cuts and nicks, as before. Also, no provision is made for other worker aids.

However, these patents address only the accessibility of screws or farrier's nails and do not solve the problem of a worker's frequent need of accessories, such as tape measure, a plumb line, a level, pencil and paper, flashlight and other items, nor do they address the problem of exposed pointed fasteners.

Thus, there is a need for a system for keeping a plurality of worker aids for holding screws, and other types of fasteners, and other items close by a worker in a handy position so that the item(s) are readily retrievable and are observable by the worker, so as to eliminate the problems of minor hand and finger injuries by screw points.

BRIEF SUMMARY OF THE INVENTION

It is therefore an object of this invention to provide a system for keeping a plurality of worker aids for holding screws and other items close by a worker in a handy position for retrieval, which is observable and eliminates the problems of minor hand and finger injuries by screw points.

In one aspect, this invention features system for aiding a worker while using a hand tool, comprising a glove mounting one member of a two-member hook-an-loop fastener system, a plurality of worker aids, including an open-top container having a bottom and upstanding side wall, the other member of the hook-and-loop fastening system mounted on the outside of the container bottom, and a magnet mounted within the container for attracting and securing magnetizable fasteners within the container, said members being interengageable to mount the container on the glove back so that the fasteners are readily accessible to the worker, but are substantially shielded.

In another aspect, this invention features worker's aid for mounting on a support surface adjacent the location of use in position for ready use by the worker, said worker's aid comprising a mounting surface, a hook-and-loop fastening system comprising hook and loop members, having one member mounted on said mounting surface, with the other member being mounted on the support surface such that the members are interengageable to mount the aid on the support surface. The aid can include one or more devices selected from the group consisting of a magnetic container, a flashlight, a tape measure, a plumb bob, and a note pad, said mounting surface being selected from the group comprising a power tool and a worker's glove.

In a further aspect, this invention features a worker's glove comprising a glove body having fingers, a palm and a back for wearing by a worker, with one member of a hook-and-loop member fastening system mounted on the back. A worker's aid device having the other hook-and-loop fastener member is mounted on a mounting surface for engaging the one member to mount the device on the glove back. In one form, the aid is a magnet for attracting and securing fasteners for ready accessibility by the worker. The worker's aid device can also be one of a group consisting of one or more devices selected from the group consisting of a magnetic container, an empty container, a flashlight, a tape measure, a plumb bob, and a note pad.

In a preferred embodiment, the aid device is a magnetic container having side walls extending above the mounting surface and having a permanent magnet secured to the container between the side walls. The magnet is operable to attract and secure fasteners within the container such that the side walls inhibit inadvertent contact by a worker using the device, while enabling ready access to the fasteners by the worker.

These and other objects and features of this invention will become more readily apparent upon reference to the following detailed description of a preferred embodiment, as illustrated in the accompanying drawings, in which:

DETAILED DESCRIPTION OF THE INVENTION

Figure 1:
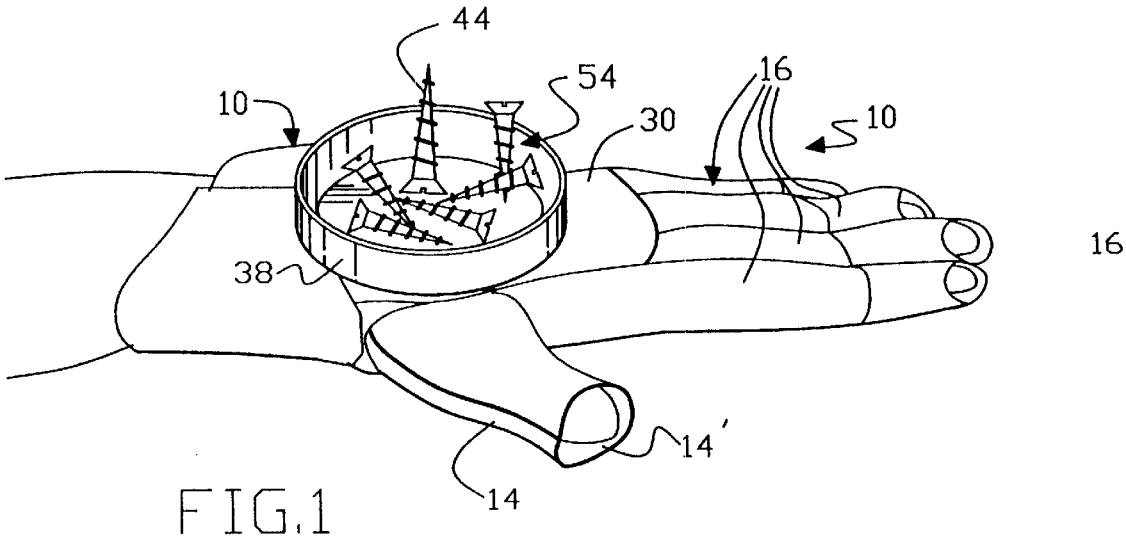
FIG. 1 is a perspective view of a worker's glove having a fastener container aid installed on its back, according to this invention.
Figure 2:
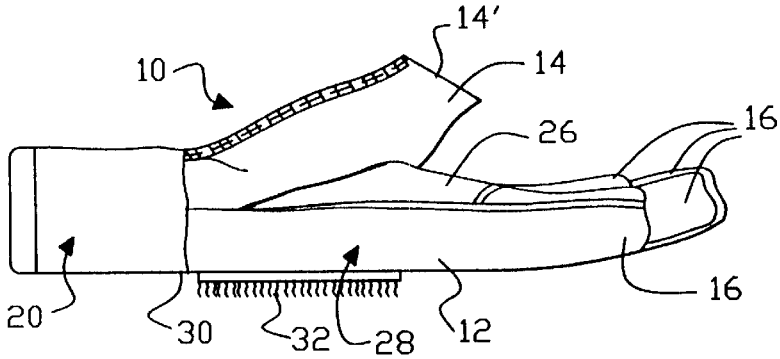
FIG. 2 is a side view of the glove of FIG. 1, shown without the aid device.
Figure 3:
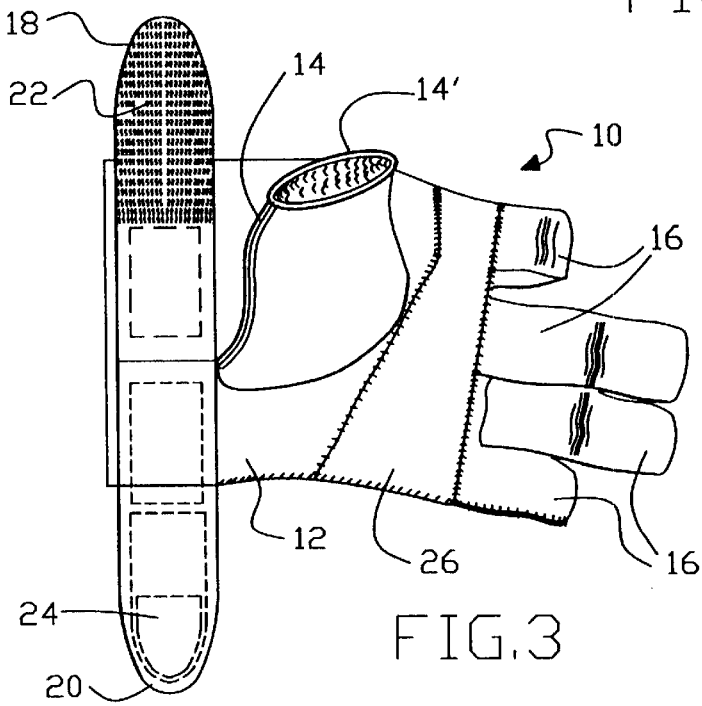
FIG. 3 is a bottom view of the glove of FIGS. 1 and 2.

FIGS. 1–3 illustrate a worker's glove 10 which has a glove body 12, fingers 14 and a thumb 16, which are preferably cut out at their ends 14', 16'. This enables glove 10 to protect the worker's hand W, yet enable use of the fingertips for maximum tactile use. Glove 10 further includes wrist straps 18, 20 which are clinched about the workman's wrist and secured by a hook-and-loop fastener system 22, 24. The palm 26 of glove 10 is padded to protect the hand palm.

A mounting pad or surface 28 is sewn, glued or otherwise secured to the back 30 of glove 10, and mounts a circle of loop material 32 which forms one member (here the loop member) of a hook-and-loop fastening system of common type. Any one of a plurality or worker's aids can be mounted on loop material 32 so as to be visible to and readily accessible to the worker. In FIG. 1, a fastener container aid 34 is shown mounted on glove back 30.

Figure 8:
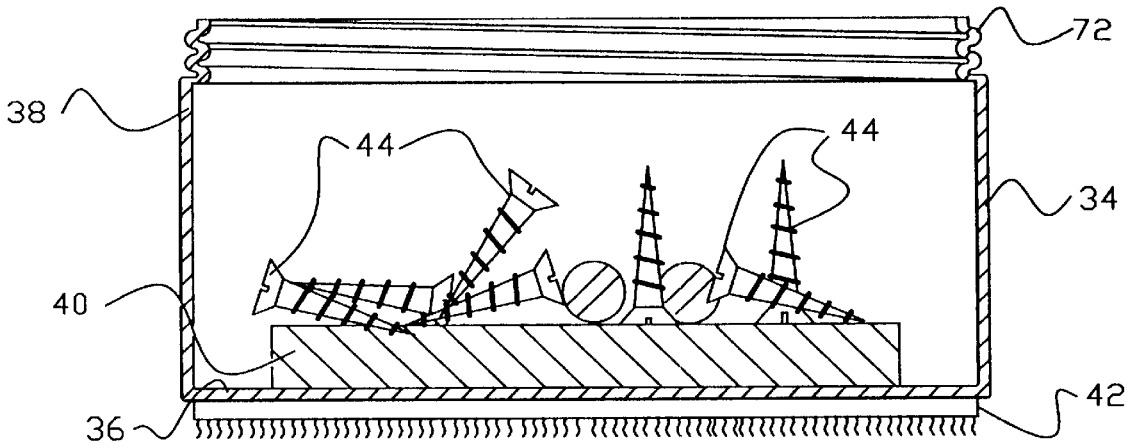
FIG. 8 is an enlarged sectional view of the fastener container aid of FIG. 1.

Fastener container aid 34, shown in greater detail in FIG. 8, includes a plastic or metal container that is preferably cylindrical and includes a bottom 36 and upstanding side walls 38. A circular permanent magnet 40 is glued or otherwise secured to the inside of bottom 36, while a segment of hook material 42 is glued or otherwise secured to the outside of bottom 36. Magnet 40 attracts and secures a plurality of fasteners, here shown as dry wall screws 44, within the interior of container aid 34, secure from inadvertent engagement by a workers body or a ladder or a wall or other object. As seen in FIG. 1, the location on the back of glove 30 places a supply of screws 44 within the vision of the worker and convenient for retrieval for use.

Figure 4:
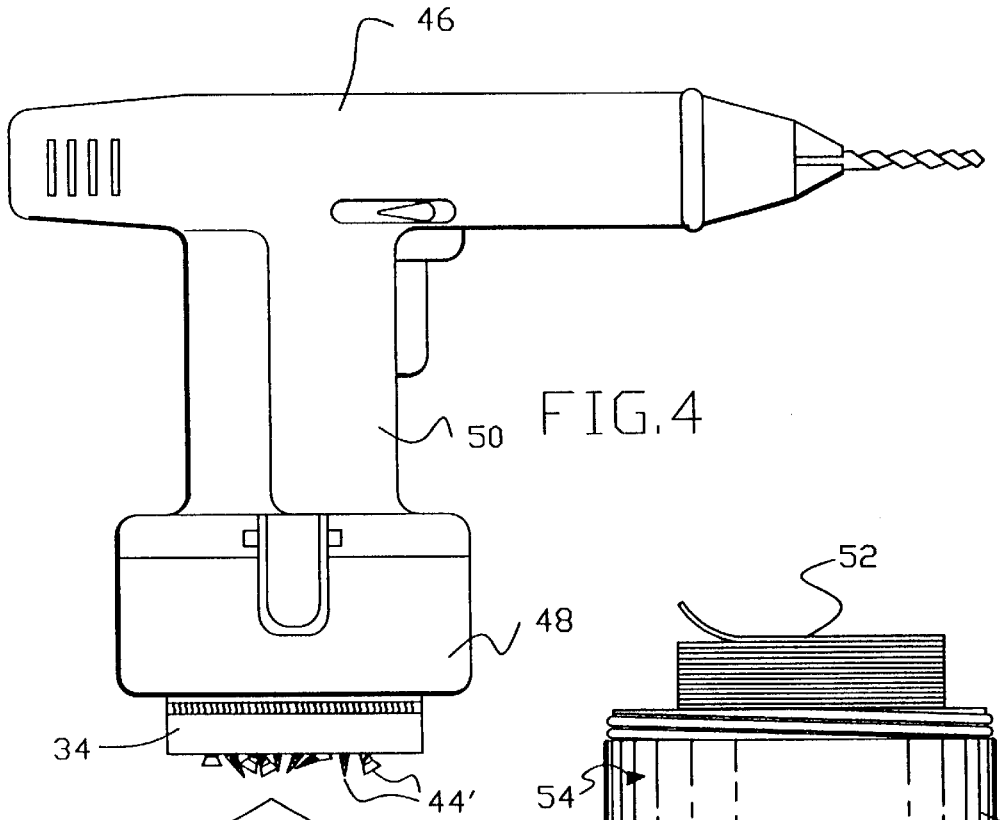
FIG. 4 is a side view of a power drill having an aid device according to this invention installed.

FIG. 4 illustrates another convenient location of fastener container 34 aid for ease of fastener retrieval. Here a power drill 46 mounts the hook material on the butt end of the battery case 48 on the end of its handle 50. Since the screws 44 are held magnetically, they do not fallout and are in convenient reach of the worker.

Figure 5:
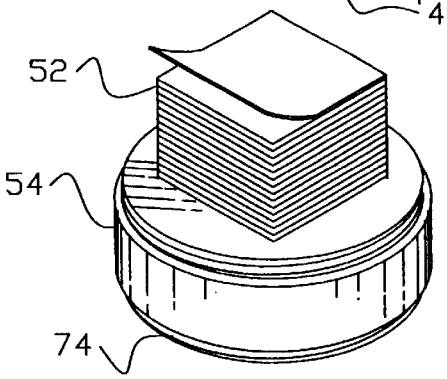
FIG. 5 is a perspective view of one of the aid devices according to this invention.
Figure 6:
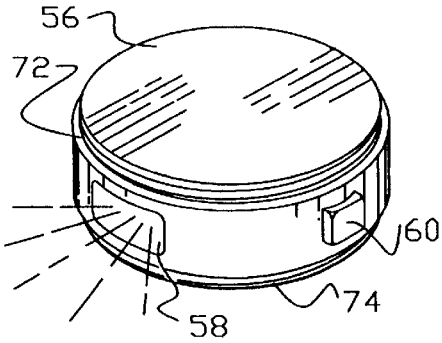
FIG. 6 is a perspective view of another of the aid devices according to this invention.
Figure 7:
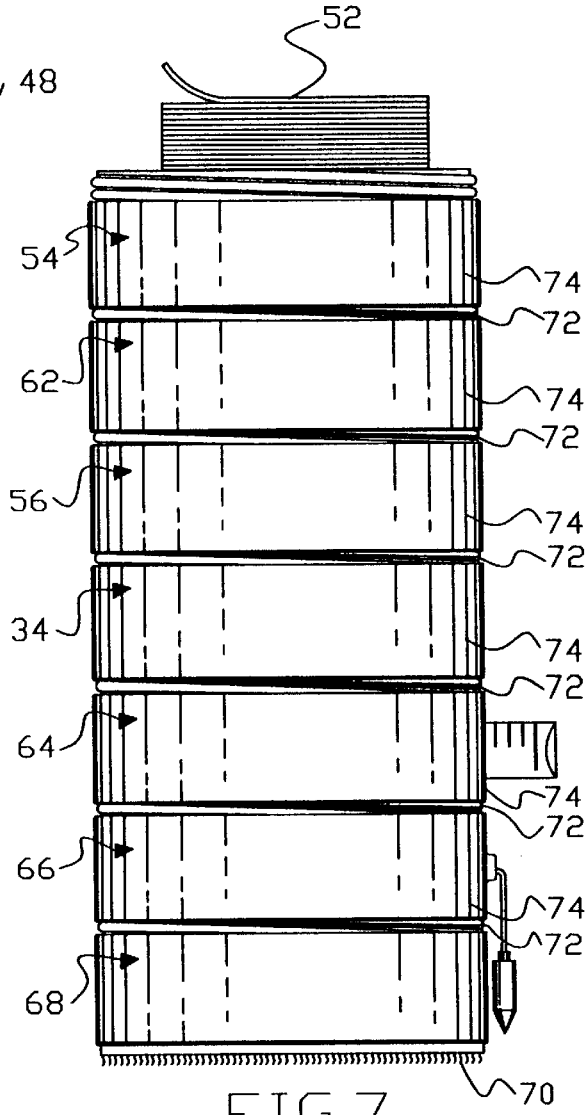
FIG. 7 is a side view of a stack of aid devices according to this invention.
Figure 9:
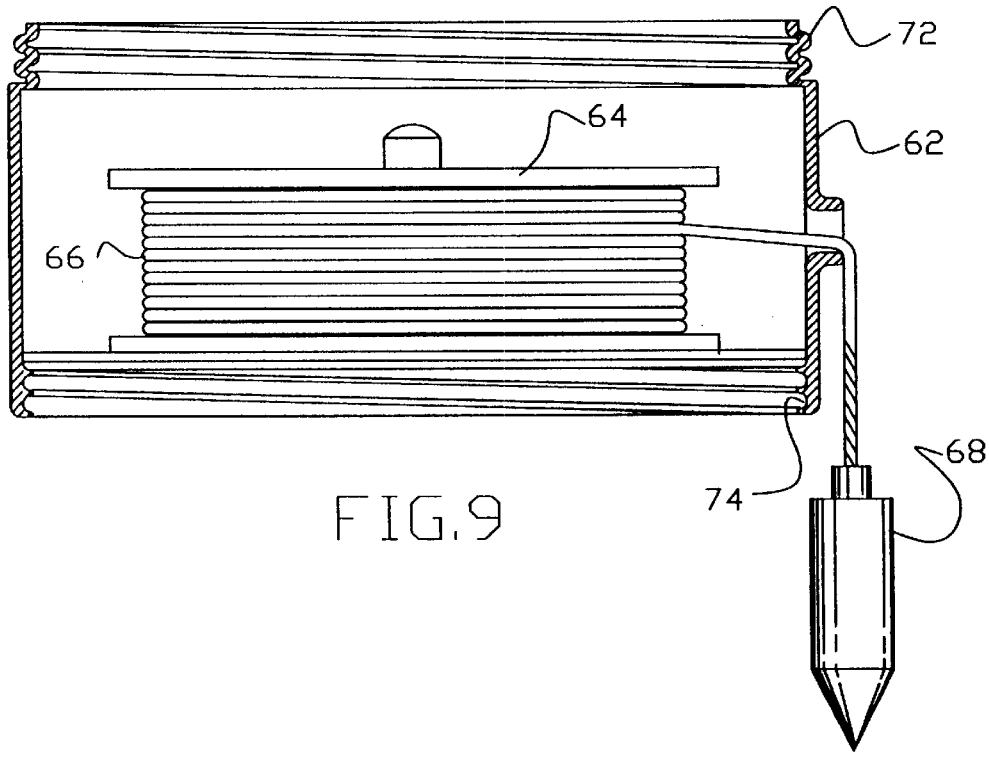
FIG. 9 is an enlarged sectional view of a plumb bob aid, according to this invention.

FIGS. 5–9 illustrate other worker's aids included in the worker's aid system. FIG. 5 shows a pad of notepaper 52 mounted on a base cylindrical 54 that may optionally house a tape measure or other aid. In FIG. 6, the aid is a cylindrical flashlight 56 that includes a lens 58 and a switch 60. FIG. 9 illustrates a circular container 62 housing a spring-loaded reel 64 that stores a reel of string 66 having a plumb bob 68 at its end. FIG. 7 shows a stack of a plurality of aids, such as a tape measure 64, a cable reel 66, and a partitioned container 68 for holding odds and ends, having the hook material 70 on its bottom outside.

To hold the various combinations of worker's aid together, male 72 and female 74 screw threads are provided on the tops and bottoms of the various aids. With this system, a worker can assemble whatever aids are needed and climb a ladder to begin work. If an aid is no longer needed, it can be unscrewed and placed in an apron pocket.

While only a preferred embodiment has been described and shown, obvious modifications are contemplated within the scope of this invention as defined by the following claims. For example, the hook-and-loop members could be switched, other types of connectors, such as snap-on or adhesive or magnetic could be used. It is also contemplated that this invention can be used to attract and hold any type of magnetizable fastener, such as nuts, bolts, washers, nails, and screws, or other magnetizable objects useful to workers such as carpenters, auto workers, and other tradesmen.

Also, the magnet in the magnetic container, when not used to attract and hold fasteners, could be used to secure another aid having magnetizable components. It is important only that the various aids can be easily attached to the glove or tool and can be easily assembled in various combinations and be easily disassembled.

I claim:

1. A worker's aid and support surface, the worker's aid for mounting on the support surface adjacent a location of use in position for ready use by the worker, said worker's aid having a mounting surface, a hook-and-loop fastening system comprising a hook member and a loop member, one said member being secured to said mounting surface, with the other said member being secured to the support surface, said aid being a magnetic container having side walls extending above the mounting surface and having a permanent magnet secured to the container between the side walls, said magnet being operable to attract and secure fasteners within the container such that the side walls inhibit inadvertent contact by a worker using the device, while enabling ready access to the fasteners by the worker, and said support surface being selected from the group comprising a power tool and a worker's glove.

2. The worker's aid and support surface of claim 1, wherein the support surface is the back of a worker's glove.

3. The worker's aid and support surface of claim 1, including a plurality of devices, one of which is a base device, selected from the group consisting of a magnetic fastener container, an empty container, a flashlight, a tape measure, a plumb bob, a level, and a note pad, and including the mounting surface, each device having cooperable connectors which connect the devices together for ready access by a worker.

4. The worker's aid and support surface of claim 1, wherein support surface is located on the butt end of a power drill handle.

5. A worker's glove comprising a glove body having fingers extending therefrom, a palm and a back for wearing by a worker, and one member of a hook-and-loop member fastening system mounted on the back, a worker's aid device having the other hook-and-loop fastener member mounted on a mounting surface for engaging the one member to mount the device on the glove back, the worker's aid device being a container having side walls and a magnet, said magnet being operable to attract and secure magnetizable objects within the container such that the side walls inhibit inadvertent contact by a worker using the device, while enabling ready access to the objects by the worker.

6. The worker's glove of claim 5, wherein the device is selected from the group consisting of one or more devices selected from the group consisting of an empty container, a flashlight, a tape measure, a plumb bob, and a note pad, and a magnetic container having side walls extending above the mounting surface and having a permanent magnet secured to the container between the side walls.

7. The worker's glove of claim 6, wherein the magnetic container is a cylindrical cup, with the magnet secured to the mounting surface and the side walls extending upward from the mounting surface.

8. The worker's glove of claim 7, wherein the glove palm is padded.

9. A system for aiding a worker while using a hand tool, comprising a glove mounting one member of a two-member hook-and-loop fastener system a plurality of worker aids having cooperable connectors for assembling two or more aids together in a stacked configuration, said aids including an open-top container having a bottom and an upstanding side wall and a magnet mounted within the container for attracting and securing magnetizable fasteners within the container back so that the fasteners are readily accessible to the worker, but are substantially shielded, one of the aids mounting the other member of the hook-and-loop fastening system so that said members are interengageable to mount the container on the glove back.

10. The system of claim 9, wherein the plurality of workers aids additionally consists of an empty container, a notepad, a plumb bob, a level, a flashlight, and a tape measure, which are mountable singly or in combination on the glove, each aid having cooperable connectors which connect the devices together.

* * * * *